United States Patent [19]

Donovan et al.

[11] Patent Number: 4,681,789

[45] Date of Patent: Jul. 21, 1987

[54] THERMAL INSULATOR COMPRISED OF SPLIT AND OPENED FIBERS AND METHOD FOR MAKING SAME

[75] Inventors: James G. Donovan, Norwell; John Skelton, Sharon, both of Mass.

[73] Assignee: Albany International Corp., Albany, N.Y.

[21] Appl. No.: 780,389

[22] Filed: Sep. 26, 1985

[51] Int. Cl.[4] ..... B32B 3/02

[52] U.S. Cl. ..... 428/93; 428/85; 428/95; 428/97; 428/221; 428/297; 428/920

[58] Field of Search ..... 428/93, 97, 904, 920, 428/297, 95, 85, 221

[56] References Cited

U.S. PATENT DOCUMENTS

| | | | |
|---|---|---|---|
| 4,233,349 | 11/1980 | Niederhauser | 428/904 |
| 4,259,393 | 3/1981 | Marco | 428/253 |
| 4,361,609 | 11/1982 | Gerlach et al. | 428/97 |

*Primary Examiner*—James J. Bell

*Attorney, Agent, or Firm*—Kane, Dalsimer, Kane, Sullivan and Kurucz

[57] ABSTRACT

A thermal insulator is disclosed which comprises fibrillated staple fibers exemplified by fibrillated fibers of poly (p-phenylene terephthalamide). The fibers are fibrillated on a carding machine equipped with metallic clothing.

6 Claims, 2 Drawing Figures

THERMAL INSULATOR COMPRISED OF SPLIT AND OPENED FIBERS AND METHOD FOR MAKING SAME

BACKGROUND OF THE INVENTION

The U.S. Government has rights in this invention pursuant to contract DAAK60-83-C-0022 awarded by the Department of the Army.

1. Field of the Invention

The invention relates to a synthetic thermal insulator made of fibrous components and more particularly relates to such material which is a replacement for down.

2. Brief Description of the Prior Art

Representative of the prior art are disclosures given in the U.S. Pat. Nos. 3,892,909; 4,042,740; 4,118,531; 4,134,167; 4,167,604; 4,364,996; 4,418,103; and U.K. Patent Application No. 2,050,818A.

The superiority of down as a lightweight clothing and bedding insulator has been recognized for centuries. In spite of several recent and very worthwhile advances in synthetic insulation, down has retained its status as the ultimate, lightweight insulator. Its insulating efficiency has not yet been equalled by a commercially available product with the minimal density of a typical down filling. Theoretical analyses suggest, and measurements confirm, that good thermal insulation performance is provided by an assembly of fine fibers, while the mechanical performance requirements of loft maintenance and recovery are contributed by fibers with a large diameter. This combination of characteristics is provided by down via a branched fiber configuration, and the value of this combination of fiber components in a synthetic down substitute is recognized in U.S. Pat. No. 4,118,531 to E. R. Hauser, which describes an assembly of fibers with two distinct diameter ranges.

While the natural down element provides an intrinsic combination of fibers with a range of diameters 10, 11, 12, it suffers from the disadvantage that the material making up the central stem 10 of the unit, which serves to attach the unit to the body of the waterfowl, is thermally and mechanically inefficient when the down units are used in combination in an insulating assembly. In contrast, the concept described in U.S. Pat. No. 4,118,531 contains no inefficient material, but suffers from the disadvantage that two distinct and very different components must be combined to give the final product. The present invention describes a unique concept for a synthetic insulator that is suitable for use in bedding and winter clothing which combines the best aspects of the natural down and the simple combination of two components, together with a technique for producing the insulation that has been invented, and they are disclosed here. The invention includes a technique for producing controlled splitting of a multitude of fibers to obtain a product consisting of many fibrils 22, small in cross-sectional dimension relative to the parent fiber 20, that are connected to and supported by an open network of sections of non-split parent fibers. The embodiment described is based upon polyaramid fiber which, by virtue of its high specific bending stiffness and great degree of longitudinal molecular orientation, is well suited to the application, but the concept is not limited to this material. The insulation material of the invention is useful as a replacement for down and down-/feather mixtures in clothing, bedding and like articles of insulation.

SUMMARY OF THE INVENTION

The invention comprises a batt-like array of partially fibrillated staple fibers for use as thermal insulation material. The invention also comprises a method of producing batt-like insulators of partially fibrillated synthetic fibers.

DETAILED DESCRIPTION OF THE PREFERRED EMBODIMENTS OF THE INVENTION

Figure 1:
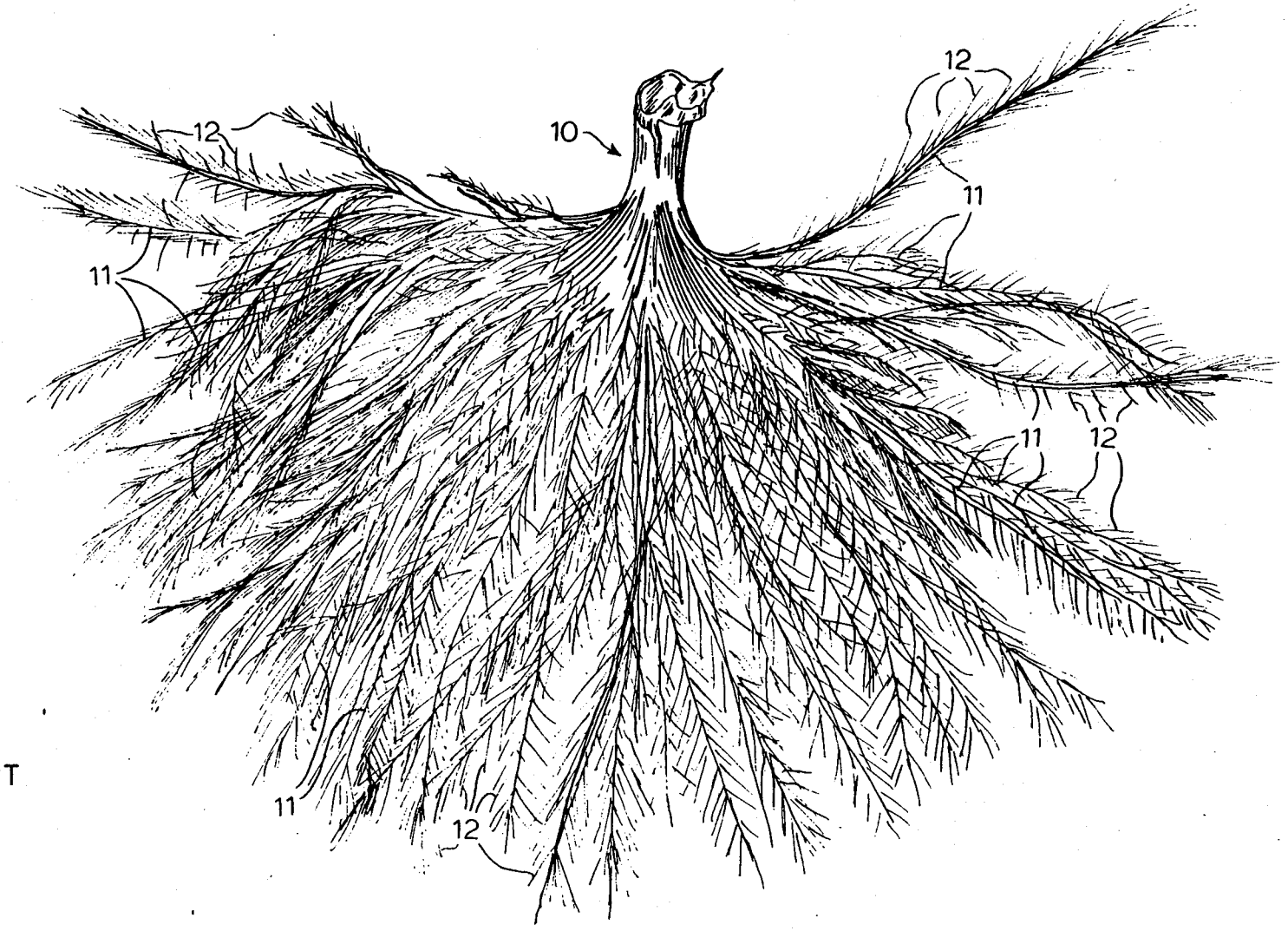
FIG. 1 PRIOR ART
FIG. 1 illustrates an enlarged, typical, waterfowl down cluster.
Figure 2:
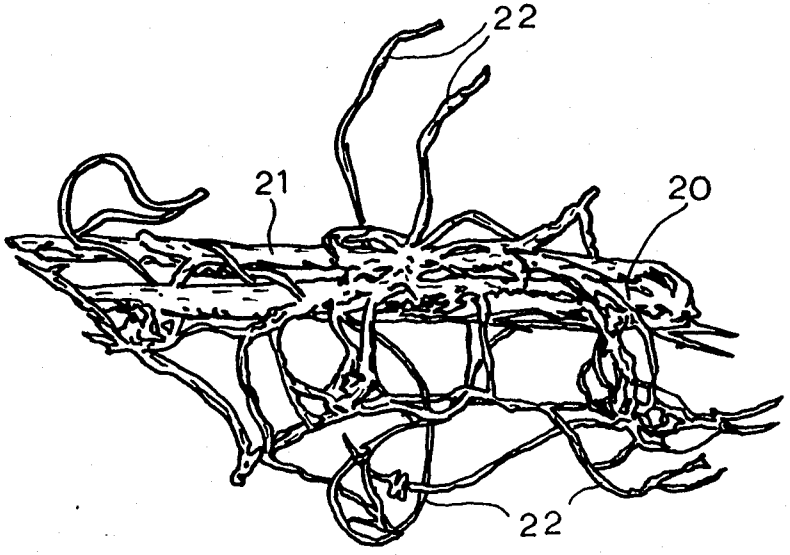
FIG. 2 is an enlarged view of a representative fibrillated staple fiber of the invention.

The term "fibrillated staple fiber" as used herein means a staple textile fiber which has been subjected to mechanical action or other process which results in splitting of the fiber over a significant fraction of the length. The fiber as shown in FIG. 2 has a split shaft 20, some of the splits 21 resulting in attached but independent fibrils 22, of relatively small diameter being split-off the base shaft 20 of the fiber.

The fibrillated staple fibers employed as replacement down according to the invention are synthetic, textile staple-fibers characterized advantageously by a high specific bending stiffness and a high degree of longitudinal molecular orientation. Representative of such staple fibers are spun and drawn fibers of polyester and, preferably of polyaramids such a poly(p-phenylene terephthalamide).

Advantageously, the fibrillated fibers are prepared from base fibers having diameters of from about 9 to about 25 microns, preferably circa 12 microns. Also advantageously, the fiber for fibrillation will have a minimum of 3 to 4 inch length.

The preferred method of fibrillating staple fibers in accordance with the invention is carried out by passing the fibers through a conventional carding machine, equipped with very fine gauge metallic clothing. The degree of fibrillation obtained may be varied by passing the fibers through the carding machine a plurality of times, and by modifying the card clothing to produce the desired result. It should be noted that the carding conditions employed for the production of the fibrillated fiber assembly are in complete contrast to those used in conventional carding of staple fibers, where the intent of the process is to produce the maximum degree of assembly openness with a minimum of fiber damage.

Handling and visual assessment of examples of the invention showed that those subjected to more than four fibrillating passes were lacking in desired mechanical properties. However, examples that had been subjected to one, two, three or four passes were tested to determine their utility in terms of loft, compressional properties, and apparent thermal conductivity. The results of these tests are reported in the Table below and show the following:

1. The fibrillation achieved with two machine passes resulted in a significant reduction in apparent thermal conductivity; from 0.344 Btu-in./hr-ft$^2$-°F. for the control value to 0.304 Btu-in./hr-ft$^2$-°F.

2. Increased levels of fibrillation resulting from each additional machine pass were generally accompanied by decreases in desirable compressional properties.

3. The low thermal conductivity and acceptable compressional characteristics of the two-pass sample indicate a good balance between useful fibrillation and fiber destruction.

In general, trial and error technique will inform one skilled in the art of the desired degree of fibrillation for a given staple fiber, and the number of passes through a carding machine to achieve the desired degree of fibrillation.

The fibrillated fibers of the invention may, optionally, be lubricated. Representative of lubricants conventionally used are aqueous solutions of organopoly-siloxanes, emulsions of polytetrafluoroethylene, non-ionic surfactants and the like. Such lubricants may be applied to the fibers by spray or dip techniques well known in the art.

The fibrillated fibers may be formed into webs or batts for use as a down replacement in clothing, bedding and like articles. The batts are advantageously made to achieve density comparable to the densities characteristic of down, i.e., on its order of less than 1.0 lb/cubic foot, typically around 0.5 lb/cubic foot.

The following examples describe the manner and process of making and using the invention and set forth the best mode contemplated by the inventors for carrying out the invention but are not to be construed as limiting. Where reported, the following tests were employed:

Minimum density was taken as a measure of filling power by shaking opened fibers in the compression test cylinder and then measuring the height of the fibrous mass under a minimal pressure of 0.002 lb/in$^2$. The mass (4.02 g in every case) and cylinder dimensions were then used to calculate "minimum density".

Thickness was measured with an applied pressure of 0.002 lb/in$^2$.

Apparent thermal conductivity was measured using the plate/sample/plate technique given in ASTM Method C518.

Compressional strain was recorded at 5 lb/in$^2$, the maximum stress in the compressional recovery test sequence.

Compressional Recovery and Work of Compression and Recovery Section 4.3.2 of Military Specification MIL-B-41826E describes a compressional-recovery test technique for fibrous batting that was adapted for this work. The essential difference between the Military Specification method and the one employed is the lower pressure at which initial thickness and recovered-to-thickness were measured. Zero gauge length condition: 4.02 g sample; 2.00 inches; 0.3 lb/ft$^3$; nominally zero load.

Resilience is equal to work-to-recover divided by work-to-compress.

The down used as an example was actually a down/feathers mixture, 80/20 by weight, per MIL-F-43097G, Type II, Class 1. This mixture is commonly and commercially referred to as "down" and may be referred to as "down" herein.

EXAMPLE

A quantity of 3 inch long, 12 micron diameter, staple fibers of poly (p-phenylene terephthalamide) (Kevlar 49, E. I. DuPont de Nemours) was obtained and divided into five parts. One part was employed as a control while each of the remaining four parts was passed through a carding machine one, two, three or four times. The carding machine was equipped with fine gauge metallic clothing. The resulting fibrillated fibers were tested for their physical properties in a web. The test results are shown in the Table, below.

TABLE

Effect of Degree of Fibrillation Upon Several Insulator Properties

| No. of Times[a] Fiber-Stock was Passed Through Card Machine | Minimum Density (lb/ft$^3$) | Compressional Strain at 5 lb/in$^2$ (%) | Compressional Recovery (%) | Work to Achieve 5 lb/in$^2$ Stress (lb-in) | Work to Recover to Zero Stress (lb-in) | Resilience (%) | Apparent Thermal Conductivity (Btu-in/hr-ft$^2$-°F.) |
|---|---|---|---|---|---|---|---|
| 0 (control) | 0.15 | 95 | 98 | 3.75 | 1.76 | 0.47 | 0.344[b] |
| 1 | 0.13 | 95 | 135 | 4.02 | 1.63 | 0.40 | — |
| 2 | 0.14 | 95 | 102 | 5.79 | 1.80 | 0.31 | 0.304[c] |
| 3 | 0.14 | 95 | 90 | 7.02 | 1.85 | 0.26 | 0.311[b] |
| 4 | 0.17 | 95 | 85 | 7.48 | 1.89 | 0.25 | — |
| Down/feathers reference data[d] | 0.24 | 97 | 66 | 2.63 | 1.77 | 0.67 | 0.275 |

[a]The control (0 passes) was opened, but not filbrillated, in a fillet-wire clothed card.
[b]Loose fiber array; 0.5 lb/ft$^3$.
[c]Fibrous batt; 0.5 lb/ft$^3$.
[d]Measured under equal densities (except for Minimum Density) and conditions.

Visual examination of the fibrillated fibers showed a network of opened, relatively small (in diameter), stiff, largely non-damaged fibers supporting many micro-sized fibrils. This network exhibited several performance characteristics that render it useful as an alternative to traditional down/feathers insulating media.

From the data shown in the Table above, it may be concluded that:

1. The control sample of Kevlar 49 (opened, 3 inch staple, not crimped, not fibrillated) exhibited a nominally useful combination of compression-related and thermal conductivity characteristics. A relatively small fiber-diameter and very high tensile modulus (which contributes to a high fiber bending-modulus) are presumed to be the elemental reasons for this good compatibility with desired insulator characteristics.

2. The moderate degree of fibrillation resulting from one pass through the metallic-clothed card apparently assisted fiber separation. The loft (minimum density) and compressional recovery of fiber subjected to one fibrillating pass are markedly improved over those of the control fiber, which was subjected to one thorough opening (nonfibrillating) pass in a fillet-wire card.

3. The fibrillation achieved with two machine passes resulted in a significant reduction in apparent thermal conductivity; from 0.344 Btu-in/hr-ft$^2$-°F. for the control value to 0.304 Btu-in/hr-ft$^2$°F. The two-pass sample was also judged to be wholly acceptable in terms of all measured compressional characteristics and represents a good balance between useful fibrillation and fiber destruction.

What is claimed:

1. A synthetic fiber batt thermal insulator material comprising an assembly of individual parent fibers which have diameters in the range of from 9 to 25 microns and provide support for a network of many fibrils, said fibrils having been split away or fibrillated from individual parent fibers and being small in cross-sectional dimension relative to the parent fibers, said batt having the following characteristics:

a density of less than 1.0, typically about 0.5 lb/cu ft;

an apparent thermal conductivity measured by the plate-to-plate method according to ASTM C518 with heat flow down of less than 0.5 Btu-in/hr-ft$^2$-°F.;

in the dry state, under a compressive stress of 5 lb/square inch, a compressive strain of at least 90% and a long-term compressive recovery of at least 85% after removal of this stress as determined by the test method of Section 4.3.2 of U.S. Military Specification MIL-B-41826E modified by use of a lower pressure at which initial thickness and recovered-to-thickness are measured;

zero gauge length condition: 4.02 g sample; 2.00 inches; 0.3 lb/ft$^3$; nominally zero load.

2. The material of claim 1 with a water repellent finish.

3. The material of claim 1 with a lubricant finish.

4. The material of claim 1 in which the fiber is poly(ethylene terephthalate).

5. The material of claim 1 in which the fiber is polyaramide.

6. The material of claim 1 in which the fiber is a polyolefin.

* * * * *